US011360436B2

(12) United States Patent
Hayashi et al.

(10) Patent No.: US 11,360,436 B2
(45) Date of Patent: Jun. 14, 2022

(54) WATER RESISTANT WATCH

(71) Applicant: Seiko Epson Corporation, Toyko (JP)

(72) Inventors: Koki Hayashi, Shiojiri (JP); Yoshihiro Naito, Okaya (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/131,853

(22) Filed: Dec. 23, 2020

(65) Prior Publication Data

US 2021/0200156 A1 Jul. 1, 2021

(30) Foreign Application Priority Data

Dec. 26, 2019 (JP) ..... JP2019-235884

(51) Int. Cl.
*G04B 37/10* (2006.01)
*G04B 3/04* (2006.01)

(52) U.S. Cl.
CPC ..... *G04B 37/106* (2013.01); *G04B 3/041* (2013.01)

(58) Field of Classification Search
CPC .... G04B 37/106; G04B 3/041; G04B 37/103; G04B 37/10; G04B 3/046; G04B 3/048; G04B 27/002; G04B 27/02
USPC ..... 368/290, 308, 319–321
See application file for complete search history.

(56) References Cited

U.S. PATENT DOCUMENTS 4,502,791 A * 3/1985 Goy ..... G04B 37/10 368/288
5,257,247 A * 10/1993 Miche ..... G04B 37/103 368/290
7,192,182 B2 * 3/2007 Hiranuma ..... G04B 37/103 368/288
8,419,269 B2 * 4/2013 Hiranuma ..... G04B 37/02 368/291
10,152,024 B2 * 12/2018 Baebler ..... G04B 37/10
10,901,370 B2 * 1/2021 Vuille ..... G04B 37/10
2018/0059620 A1 3/2018 Baebler et al.

FOREIGN PATENT DOCUMENTS

JP S52-149155 A 12/1977
JP H07-023296 U 4/1995
JP 2018-031774 A 3/2018

* cited by examiner

*Primary Examiner* — Edwin A. Leon
(74) *Attorney, Agent, or Firm* — Harness, Dickey & Pierce, P.L.C.

(57) ABSTRACT

A watch includes: a crown including a head portion and a shaft portion; a stem pipe including a first surface that includes an insertion hole through which the shaft portion is inserted and has a distance from a surface of the shaft portion as a first distance in cross-sectional view, and a second surface that is provided at a position closer to an end portion of the insertion hole than the first surface and has a distance from the surface of the shaft portion as a second distance larger than the first distance; a packing disposed between the surface of the shaft portion and the first surface; and a metal ring that is disposed between the surface of the shaft portion and the second surface and is in contact with the packing.

6 Claims, 5 Drawing Sheets

WATER RESISTANT WATCH

The present application is based on, and claims priority from JP Application Serial Number 2019-235884, filed Dec. 26, 2019, the disclosure of which is hereby incorporated by reference herein in its entirety.

BACKGROUND

1. Technical Field

The present disclosure relates to a watch having a water resistant function.

2. Related Art

In a watch having a water resistant function, it is necessary to ensure water resistant performance of an operation unit such as a crown. In particular, a saturated diving watch such as a diver's watch that can be used for diving work is required to have a water resistant structure that can withstand a water pressure of 20 atm or more, for example.

JP-A-52-149155 discloses a watch having a water resistant structure in which a synthetic rubber packing and a packing holding ring made of a synthetic resin are provided inside a stem pipe, and the packing holding ring is pushed into an inner wall of a crown. A groove portion for bitting and fixing the packing holding ring that holds the synthetic rubber packing is formed at an inner end portion of the stem pipe.

However, in the water resistant structure of JP-A-52-149155, there is a problem that it is difficult to secure water resistant performance required for a saturated diving watch. Specifically, since the packing is held by the packing holding ring made of a synthetic resin and the packing holding ring is fixed by bitting, there is a risk that the packing holding ring may come off due to a pressure change under high pressure in the deep sea.

Therefore, an object of the present disclosure is to provide a watch having a water resistant structure with which excellent water resistant performance can be obtained.

SUMMARY

A watch includes: a crown including a head portion and a shaft portion; a stem pipe including a first surface that includes an insertion hole through which the shaft portion is inserted and has a distance from a surface of the shaft portion as a first distance in cross-sectional view, and a second surface that is provided at a position closer to an end portion of the insertion hole than the first surface is and has a distance from the surface of the shaft portion as a second distance larger than the first distance; a packing disposed between the surface of the shaft portion and the first surface; and a metal ring that is disposed between the surface of the shaft portion and the second surface and faces the packing.

DESCRIPTION OF EXEMPLARY EMBODIMENTS

Embodiments

In the present embodiment, a characteristic example of an underwater diver's watch will be described with reference to the drawings.

Figure 1:
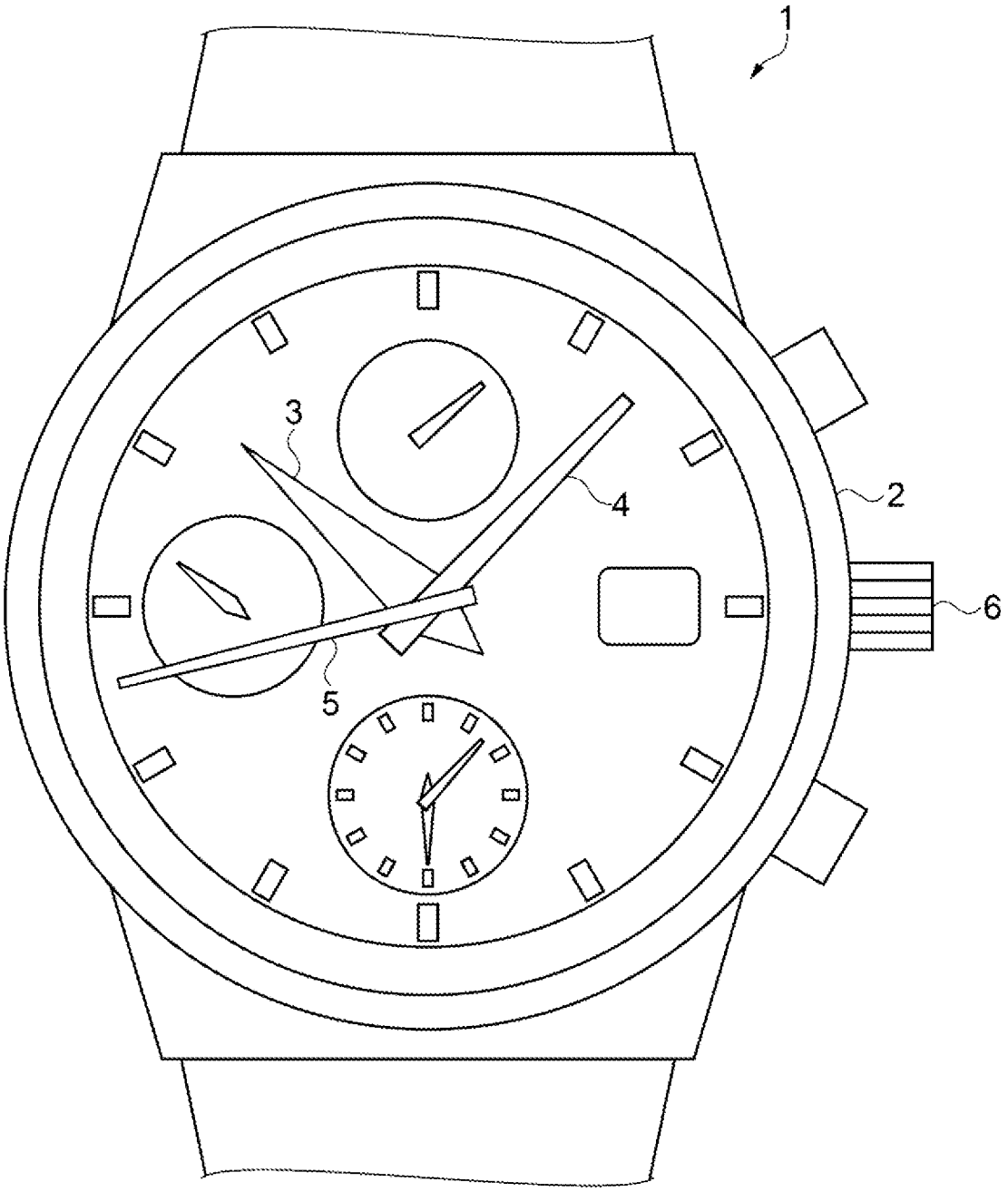
FIG. 1 is a schematic plan view showing a configuration of a watch.

As shown in FIG. 1, a watch 1 incudes a body 2. An hour hand 3, a minute hand 4, and a second hand 5 are disposed on the body 2. The hour hand 3, minute hand 4, and second hand 5 indicate the hours, minutes, and seconds of the current time, respectively. The watch 1 includes a crown 6 on a right side surface of the body 2 in the figure. The crown 6 can be pulled out a predetermined length rightward in the figured. The crown 6 is rotatable after being pulled out. An operator can adjust a position of the minute hand 4 by rotating the crown 6. After adjusting the position of the minute hand 4, the operator pushes the crown 6 toward the body 2. The minute hand 4 cannot be adjusted in a state in which the crown 6 has been pushed into the body 2. Further, the operator can rotate and lock the crown 6 so that the crown 6 cannot be pulled out.

Figure 2:
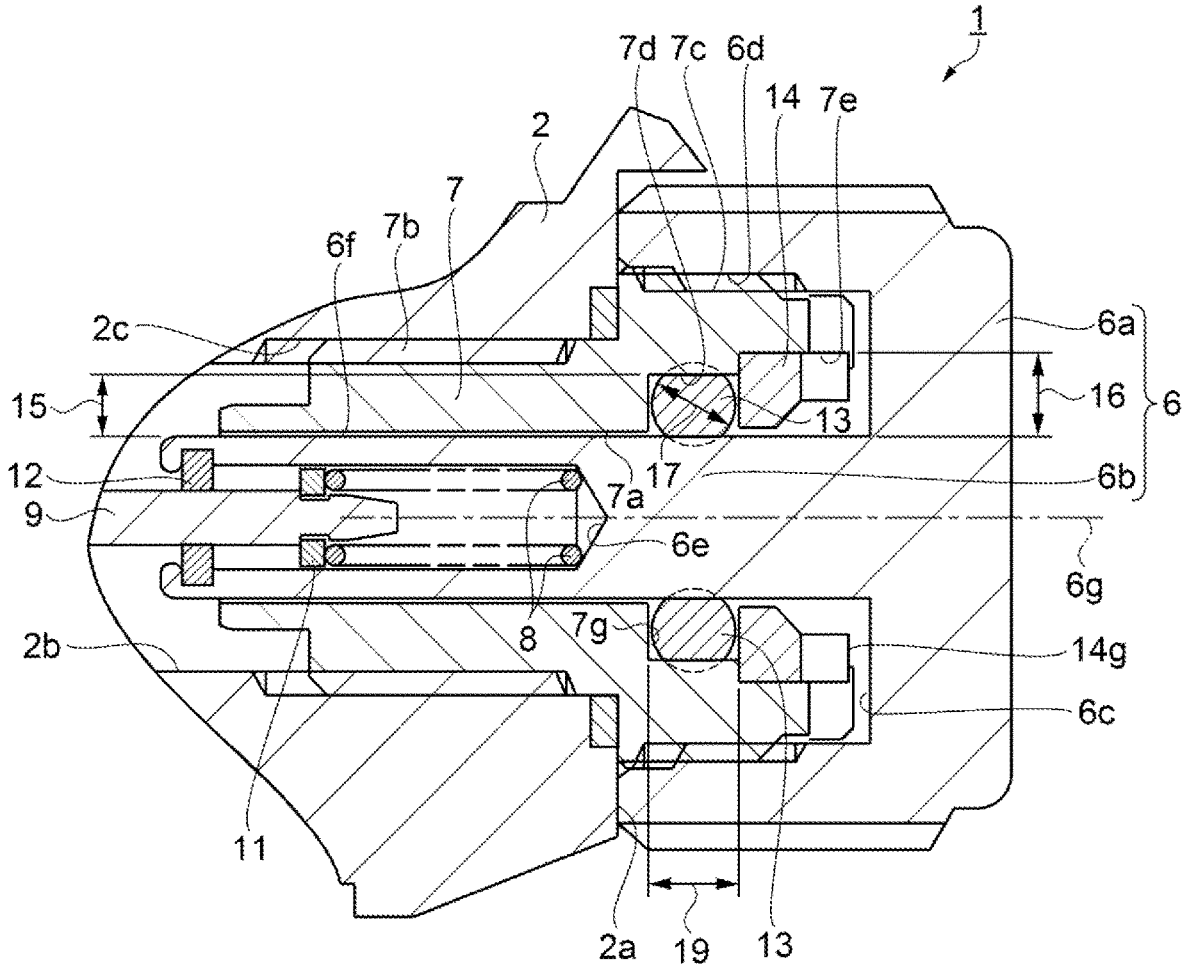
FIG. 2 is a schematic side cross-sectional view of a main portion showing a configuration of a crown.

As illustrated in FIG. 2, the body 2 includes a lateral hole 2*b* on a side surface 2*a* thereof. A first female screw 2*c* is formed in the lateral hole 2*b*. A cylindrical stem pipe 7 is inserted into the lateral hole 2*b*. The stem pipe 7 includes an insertion hole 7*a* coaxial with the lateral hole 2*b*. The crown 6 has a head portion 6*a* and a shaft portion 6*b*. The shaft portion 6*b* is inserted into the insertion hole 7*a*. The insertion hole 7*a* is a bearing of the shaft portion 6*b*. When the head portion 6*a* rotates, the crown 6 rotates about the shaft portion 6*b*. A surface 6*f* of the shaft portion slides with the insertion hole 7*a*, so that the shaft portion 6*b* can move along an axis 6*g* of the shaft portion 6*b* relative to the stem pipe 7.

The stem pipe 7 is provided with a first male screw 7*b* and a second male screw 7*c* on an outer circumferential side thereof. The first male screw 7*b* is screwed to the first female screw 2*c* of the body 2. A method of fixing the stem pipe 7 to the body 2 may be brazing. The head portion 6*a* of the crown 6 includes a recessed portion 6*c* on the shaft portion 6*b* side. The recessed portion 6*c* includes a second female screw 6*d* on a surface facing the surface 6*f* of the shaft portion. When the crown 6 is rotated while being pushed into the body 2, the second female screw 6*d* is screwed onto the second male screw 7*c*. The crown 6 is screwed onto the stem pipe 7. When diving, the crown 6 is locked by screwing the crown 6 onto the stem pipe 7, so that high water resistant performance can be ensured.

In the shaft portion 6*b*, the crown 6 includes a winding stem insertion hole 6*e* coaxially provided in the shaft portion 6*b*. A spring 8 and a winding stem 9 are inserted into the winding stem insertion hole 6*e*. A first C-ring 11 is fixed to the winding stem 9. The spring 8 presses the first C-ring 11 in the winding stem insertion hole 6*e*. The winding stem 9 is elastically biased by the spring 8.

A second C-ring 12 is fixed to the winding stem insertion hole 6*e* at a left end of the winding stem insertion hole 6*e* in the figure. An inner circumferential surface of the second C-ring 12 slides on the winding stem 9. When the crown 6 is pulled out, the second C-ring 12 abuts the first C-ring 11. The winding stem 9 is pulled out through the first C-ring 11. When the crown 6 rotates, torque is transmitted to the winding stem 9 via the second C-ring 12 and the first C-ring 11, and thus the winding stem 9 rotates.

Figure 3:
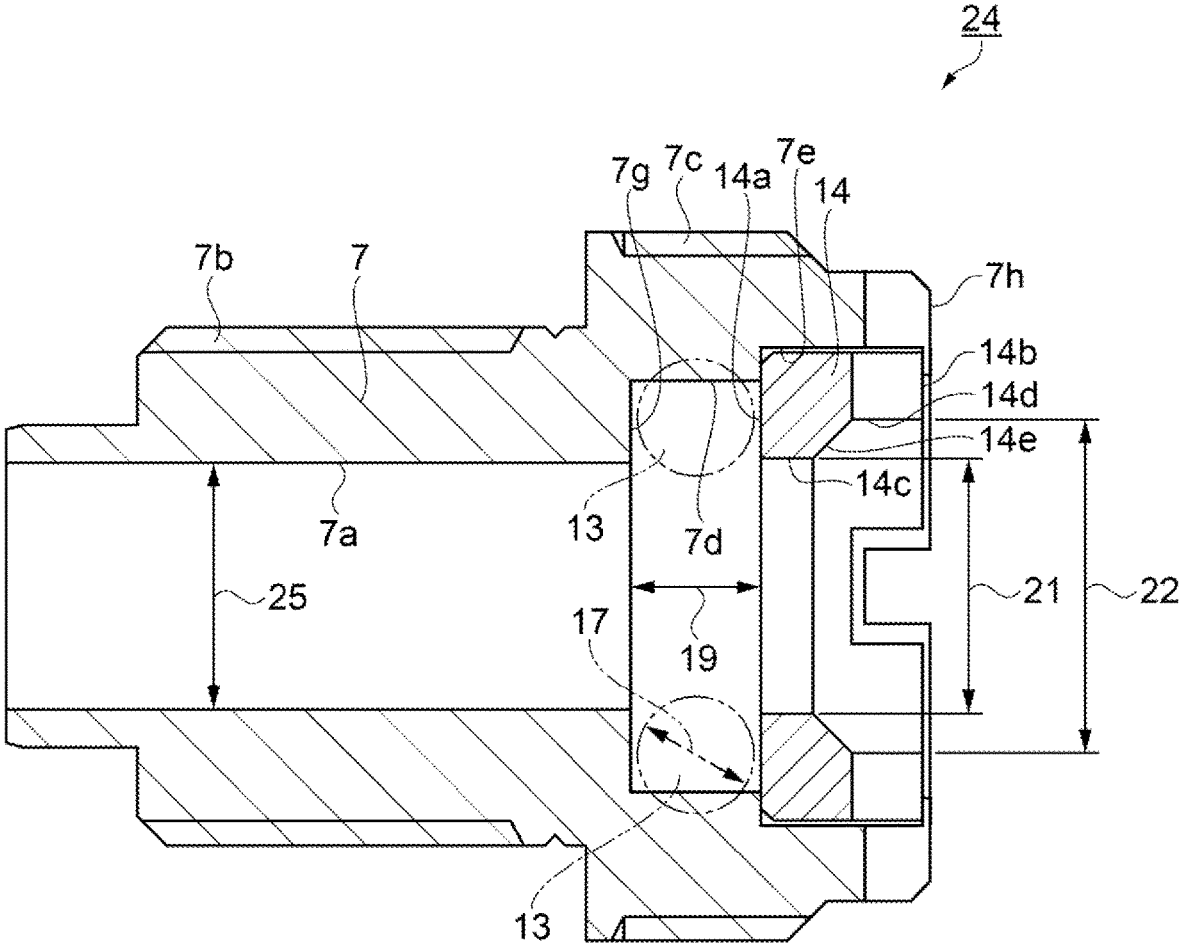
FIG. 3 is a schematic side cross-sectional view of a main portion showing a configuration of a stem pipe.
Figure 4:
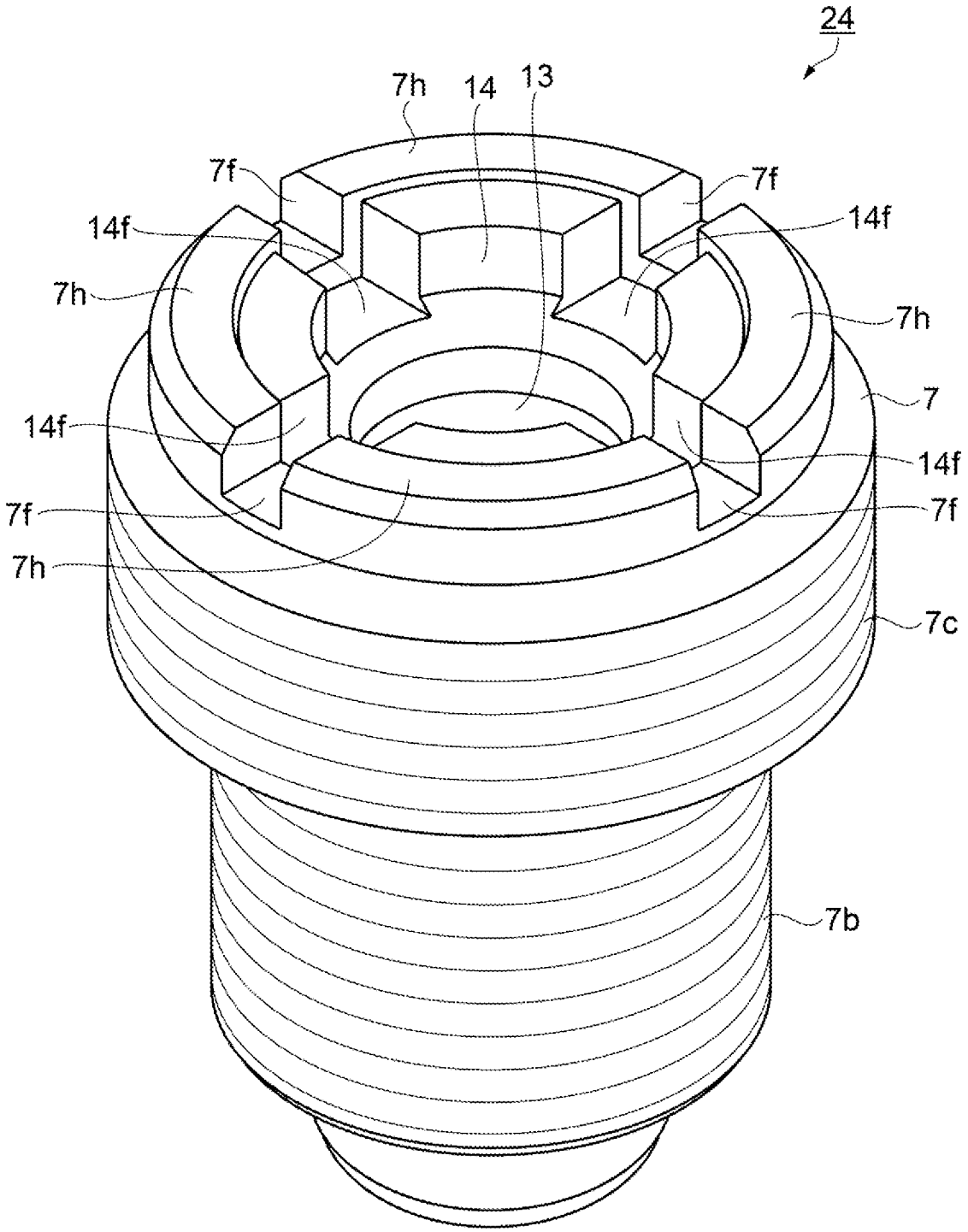
FIG. 4 is a schematic perspective view showing the configuration of the stem pipe.

As shown in FIGS. 3 and 4, the stem pipe 7 has a first surface 7*d* and a second surface 7*e* on the head portion 6*a* side of the crown 6. The second surface 7*e* is provided at a position closer to an end portion of the insertion hole 7*a* than the first surface 7*d* is. Accordingly, the first surface 7*d* is positioned between the insertion hole 7*a* and the second surface 7*e*. A packing 13 is disposed between the surface 6*f* of the shaft portion and the first surface 7*d*. A metal ring 14 is disposed between the surface 6*f* of the shaft portion and the second surface 7*e*. The metal ring 14 faces the packing 13. In cross-sectional view of a cross-section passing through the axis 6*g* of the shaft portion, a distance between the surface 6*f* of the shaft portion and the first surface 7*d* is a first distance 15. A distance between the surface 6*f* of the shaft portion and the second surface 7*e* is a second distance 16. The second distance 16 is larger than the first distance 15.

A shape of the packing 13 is a ring shape, and a cross-sectional shape of the packing 13 before being assembled to the stem 7 is a substantially circular shape. A material of the packing 13 is an elastic rubber. When the packing 13 is assembled to the stem pipe 7, the packing 13 is interposed between the surface 6*f* of the shaft portion and the first surface 7*d*. The packing 13 is interposed between the surface 6*f* of the shaft portion and the first surface 7*d*, and a cross-sectional shape of the packing 13 becomes substantially a quadrangle as shown in FIG. 2.

A shape of the metal ring 14 is a ring shape. A material of the metal ring 14 is preferably a metal having rigidity and that is not easily corroded. In the present embodiment, for example, titanium or a titanium alloy is used for the metal ring 14 and the stem pipe 7. Alternatively, stainless steel may be used for the metal ring 14 and the stem pipe 7. In the present embodiment, for example, titanium or titanium alloys are also used for materials of the winding stem 9, the body 2, the crown 6, the first C-ring 11, and the second C-ring 12. Stainless steel may be used for the materials of the winding stem 9, the body 2, the crown 6, the first C-ring 11, and the second C-ring 12.

A position of the packing 13 is restricted by the metal ring 14 and a third surface 7*g* of the stem pipe that faces the metal ring 14 with the packing 13 interposed therebetween, and the packing 13 is in a compressed state between the first surface 7*d* of the stem pipe 7 and the surface 6*f* of the shaft portion, so that required water resistantness can be ensured. Unlike the known water resistant structure in which there is a risk of the packing holding ring coming off in the deep sea because the packing holding ring made of a synthetic resin is used, by using the metal ring 14, the metal ring 14 does not come off even in the deep sea, so that water resistantness can be reliably ensured. Further, by using the metal ring 14 having higher mechanical strength than a synthetic resin, the water resistant structure can be miniaturized. Therefore, the watch 1 having a compact size and excellent water resistant structure can be provided.

In a state in which no force is applied to the packing 13, a cross-section of the packing 13 is substantially circular. A diameter of the packing 13 is defined as a thickness 17 of the packing. The thickness 17 of the packing is larger than the first distance 15. The packing 13 is in a compressed state between the first surface 7*d* of the stem pipe 7 and the surface 6*f* of the shaft portion, and a desired crushing allowance can be obtained, and thus the necessary water resistantness can be ensured.

In the cross-sectional view of the cross-section passing through the axis 6*g* of the shaft portion, the stem pipe 7 has the third surface 7*g* that faces the metal ring 14 with the packing 13 interposed therebetween. A distance between the third surface 7*g* and the metal ring 14 is defined as a third distance 19. The third distance 19 is larger than the thickness 17 of the packing. When the packing 13 is compressed between the first surface 7*d* of the stem pipe 7 and the surface 6*f* of the shaft portion, a space in which the packing 13 deforms can be secured.

As shown in FIG. 3, the metal ring 14 has an inner surface 14*a* and an outer surface 14*b*. The inner surface 14*a* is a surface facing the packing 13. The outer surface 14*b* is a surface facing the head portion 6*a* of the crown 6. The metal ring 14 includes a first opening 14*c* serving as an opening and a second opening 14*d* serving as an opening. The metal ring 14 includes an inclined surface 14*e* between the first opening 14*c* and the second opening 14*d*. The shaft portion 6*b* of the crown 6 is inserted through the first opening 14*c* and the second opening 14*d*.

The first opening 14*c* is an opening of the inner surface 14*a*. The second opening 14*d* is an opening of the outer surface 14*b*. A diameter of the first opening 14*c* is defined as a first diameter 21. A diameter of the second opening 14*d* is defined as a second diameter 22. The second diameter 22 is larger than the first diameter 21.

The inclined surface 14*e* is provided between the first opening 14*c* and the second opening 14*d*. The inclined surface 14*e* changes a diameter of the opening from the second diameter 22 of the outer surface 14*b* to the first diameter 21 of the inner surface 14*a*.

When the packing 13 is replaced for after-sales service, the packing 13 can be easily taken out of and inserted into the larger opening of the outer surface 14*b* through the inclined surface 14*e*. Specifically, a tip of a rod that is bent is inserted between the third surface 7*g* and the packing 13, and the packing 13 is hooked on the tip of the rod and taken out. Since the second opening 14*d* is wider than the first opening 14*c*, it is easy to operate the rod.

An object obtained by combining the stem pipe 7 and the metal ring 14 is referred to as a packing box 24. When the packing 13 is disposed in the packing box 24, the packing 13 is pressed in with a rod. The packing 13 is slid along the inclined surface 14*e*, and the operator passes the packing 13 through the first opening 14*c*. At this time, since the inclined surface 14*e* is a guide surface for moving the packing 13, the packing 13 can be easily inserted between the inner surface 14*a* of the metal ring 14 and the third surface 7*g*. For this reason, the packing box 24 can easily replace the packing 13.

The first diameter 21 of the first opening 14*c* of the metal ring 14 is larger than a third diameter 25 serving as a diameter of the insertion hole of the stem pipe 7. The insertion hole 7*a* is positioned deeper than a place at which the packing 13 is disposed when viewed from the head portion 6*a* side of the crown 6. When the packing 13 degrades, the packing 13 is replaced for after-sales service. At the time of replacing the packing 13, it is performed in a state in which the metal ring 14 is fixed to the stem pipe 7. The first opening 14*c* that is the opening at the place at which the packing 13 is installed is larger than the insertion hole 7*a*. Therefore, when the packing 13 is replaced in the after-sales service, the packing 13 can be easily replaced.

Figure 5:
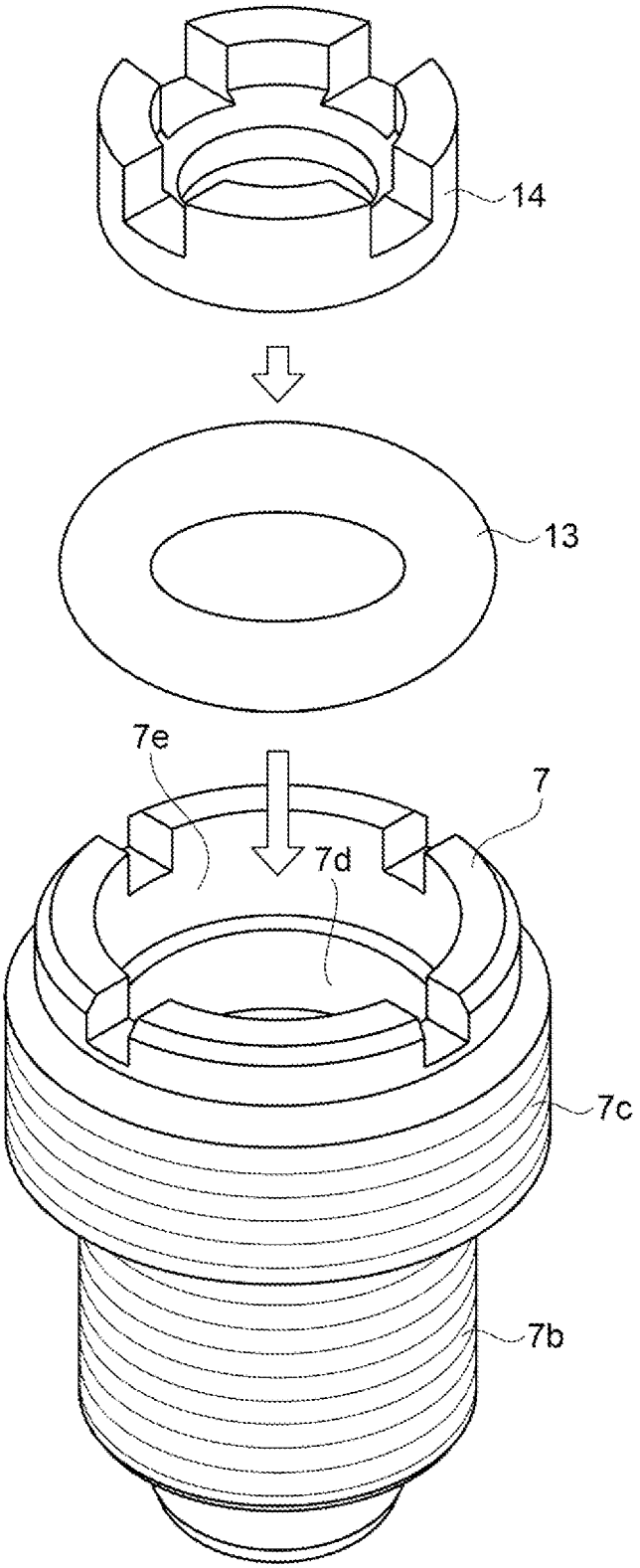
FIG. 5 is an exploded perspective view showing the configuration of the stem pipe.

A procedure for assembling the stem pipe 7, the packing 13, and the metal ring 14 will be described. As shown in FIG. 5, the packing 13 is inserted to come into contact with the first surface 7*d* of the stem pipe 7. Next, the metal ring

14 is press-fitted into the second surface 7*e*. As a result, as shown in FIG. 4, the packing 13 and the metal ring 14 are disposed in the stem pipe 7.

The stem pipe 7 and the metal ring 14 include first grooves 7*f* and second grooves 14*f* on the head portion 6*a* side of the crown 6, respectively. The first grooves 7*f* and the second grooves 14*f* extend in two orthogonal directions. The metal ring 14 is disposed in the stem pipe 7 such that the first grooves 7*f* and the second grooves 14*f* overlap each other. When the stem pipe 7 is screwed and fixed to the body 2, a tip of a screwdriver is inserted into the first grooves 7*f* and the second grooves 14*f* to rotate the stem pipe 7. Therefore, the packing box 24 can be easily screwed onto the body 2.

Next, the metal ring 14 is fixed to the stem pipe 7 by caulking or welding at an end portion 7*h* of the head portion 6*a* side of the crown 6. In FIG. 4, the metal ring 14 is fixed to the stem pipe 7 by welding. The stem pipe 7 may be plastically deformed by caulking to fix the metal ring 14. The metal ring 14 can be firmly fixed to the stem pipe 7 by caulking or welding.

The packing box 24 is configured of two parts of the stem pipe 7 and the metal ring 14. When the stem pipe 7 and the metal ring 14 are formed into one body, a dedicated bite is required to process the first surface 7*d* with a lathe. Since this bite has a special shape, maintenance of the bite takes many man-hours. When the stem pipe 7 and the metal ring 14 are separate members, a bite can be inserted from the head portion 6*a* side of the crown 6 to process the first surface 7*d* of the stem pipe 7. Therefore, the first surface 7*d* can be easily formed with a normal bite.

In the packing box 24, a length obtained by adding the third distance 19 and a width of the metal ring 14 can be shortened. Since the head portion 6*a* of the crown 6 can be made smaller, the packing box 24 can be used not only for a diver's watch but also for a general water resistant watch. Additionally, the packing 13 is configured to be accommodated in a space formed by the first surface 7*d* and the third surface 7*g* of the stem pipe 7 and the inner surface 14*a* of the metal ring 14, so that the watch can be designed without changing the diameter of the shaft portion 6*b* of the crown 6 even when the thickness of the packing 13 is changed in accordance with requirements of water resistant performance. That is, according to the present embodiment, a case does not need to be increased in size because it is not necessary to increase the diameter of the shaft portion 6*b* in order to realize excellent water resistant performance, so that the watch 1 including the water resistant structure which is compact and can achieve excellent water resistant performance can be provided.

What is claimed is:

1. A watch comprising:

a crown including a head and a shaft;

a stem pipe including an insertion hole having a first diameter through which the shaft is inserted, a first surface having a second diameter larger than the first diameter of the insertion hole and having a distance from a surface of the shaft as a first distance in cross-sectional view, and a second surface provided at a position closer to an end of the insertion hole than the first surface and having a distance from the surface of the shaft as a second distance larger than the first distance;

a packing disposed between the surface of the shaft and the first surface; and a metal ring that is disposed between the surface of the shaft and the second surface and faces the packing, the metal ring being fixed to the stem pipe.

2. The watch according to claim 1, wherein a thickness of the packing is larger than the first distance.

3. The watch according to claim 1, wherein the stem pipe has a third surface that faces the metal ring with the packing interposed therebetween in cross-sectional view, and a distance between the third surface and the metal ring is larger than a thickness of the packing.

4. The watch according to of claim 1, wherein the metal ring has a ring shape and has an inner surface facing the packing and an outer surface facing the head of the crown, and a diameter of an opening of the metal ring through which the shaft of the crown is inserted is a third diameter on an inner surface thereof, and is larger than a diameter on an outer surface thereof.

5. The watch according to claim 4, wherein the third diameter of the opening of the metal ring is larger than the first diameter of the insertion hole in the stem pipe.

6. The watch according to claim 1, wherein the metal ring is fixed to the stem pipe by caulking or welding at an end portion of the stem pipe on a side of the head of the crown.

* * * * *